US005192074A

United States Patent [19]

Ashihara

[11] Patent Number: 5,192,074

[45] Date of Patent: * Mar. 9, 1993

[54] GUARD BATON WITH ROTATING CROSSHANDLE

[76] Inventor: Hideyuki Ashihara, 360-1, 8-chome, Sanbancho, Matsuyama-shi, Ehime-ken, Japan

[ * ] Notice: The portion of the term of this patent subsequent to Oct. 23, 2007 has been disclaimed.

[21] Appl. No.: 820,016

[22] Filed: Jan. 13, 1992

Related U.S. Application Data

[63] Continuation of Ser. No. 588,525, Sep. 26, 1990, abandoned, which is a continuation of Ser. No. 313,003, Feb. 21, 1989, abandoned.

[30] Foreign Application Priority Data

| | | | |
|---|---|---|---|
| Feb. 27, 1988 | [JP] | Japan | 63-45512 |
| Mar. 19, 1988 | [JP] | Japan | 63-66803 |
| May 20, 1988 | [JP] | Japan | 63-124713 |
| Dec. 29, 1988 | [JP] | Japan | 63-335208 |

[51] Int. Cl.[5] ..... F41B 15/02

[52] U.S. Cl. ..... 273/84 R

[58] Field of Search ..... 273/84 R, 84 ES, 67 R; 74/551.9; 362/102

[56] References Cited

U.S. PATENT DOCUMENTS

| | | | |
|---|---|---|---|
| 1,842,922 | 1/1932 | Frantzius . | |
| 2,391,782 | 12/1945 | Hutchison | 273/84 |
| 3,385,601 | 5/1968 | Black | 273/84 R |
| 3,716,170 | 2/1973 | Mangels | 222/162 |
| 4,109,912 | 8/1978 | Zentmyer | 273/84 |
| 4,132,409 | 1/1979 | Taylor | 273/84 |
| 4,203,599 | 5/1980 | Starrett | 273/84 |
| 4,403,787 | 9/1983 | Shimano | 74/551.9 |
| 4,479,171 | 10/1984 | Mains | 362/102 |
| 4,667,958 | 5/1987 | Raitto | 273/84 R |
| 4,694,981 | 9/1987 | Miller, Jr. | 224/251 |
| 4,739,990 | 4/1988 | Aguirre et al. | 273/84 |
| 4,964,636 | 10/1990 | Ashihara | 273/84 R |

FOREIGN PATENT DOCUMENTS

| | | |
|---|---|---|
| 831626 | 6/1938 | France . |
| 1287775 | 2/1962 | France . |
| 2491719 | 10/1980 | France . |

OTHER PUBLICATIONS

"Dick Tracy" (Comic Strip), Washington Post, May 31, 1970.

*Primary Examiner*—V. Millin
*Assistant Examiner*—William M. Pierce
*Attorney, Agent, or Firm*—Nikaido, Marmelstein, Murray & Oram

[57] ABSTRACT

A crosshandled guard baton which comprises a longitudinal club and a crosshandle is branched thereon at a place toward a club end with a branching length comparable to a breadthal length of man's hand palm and is comprised of two or three portional grip members which are laid one another to form a stand on a mounting base on the club, wherein a shaft is secured on the mounting base and is extended internally of the crosshandle to reach through a top end of the upper grip, and the shaft is rotatably supported with one or two grip members while remaining grip is fastened to the shaft such that the club is turnable around the crosshandle with same spin motion of the secured grip, keeping the others in independence of a motion with the club, thereby enlarged KARATE actions being enabled, and additional improvement is directed to devices to quickly stop a swing motion of the club and to devices to shoot light or a gas for increase to defend self against an assailant.

12 Claims, 12 Drawing Sheets

GUARD BATON WITH ROTATING CROSSHANDLE

This application is a continuation of application Ser. No. 588,525 filed Sep. 26, 1990, now abandoned which is a continuation of application Ser. No. 313,003, filed Feb. 21, 1989, now abandoned.

FIELD OF THE INVENTION

This invention relates to a guard baton or police billy or the like. Particularly, this relates to a crosshandled guard baton.

DESCRIPTION OF THE CONVENTIONAL ART

The term "a crosshandled guard baton" is intended to indicate a guard baton which has a short handle branchedly secured on a main club body at midway between an end and a central portion of the club length. A guard baton of this type is described in U.S. Pat. No. 4,132,409 which has been only the sole conventional art according to the inventor's knowledge.

In this U.S. patent, the handle is axially divided to two portions, stationary and rotatable, and the description therein teaches that the stationary one is acted when braking for rotating or swinging motions of the club is intended. However, in view of the fact that it is not determinable whether the handle is gripped by the right hand or the left hand of a baton user, and a change of gripping the handle from the right hand to left or vice versa is probable, thus, a device for braking the rotating club should be improved to be more convenient to prepare for gripping by either hand, which was the starting point of this invention and, in addition thereto, new devices are introduced to this inventive baton as the description herein proceeds.

On the other hand, KARATE, a kind of sports or practice for combat without a hand weapon, has become popular in the world and such a combat practice is sometimes used by an assailant to the police or security personnel and therefore, those who are entitled to wear such a guard property as a baton are desirous that their guard property be improved, in particular, be improved so as to realize KARATE actions on an enlarged scale, to which purpose a rotatable crosshandled baton is basically appropriate and improvement in the braking device for a guard baton is found to be suited, because in KARATE techniques wielding of two hands is important, but at the same time, a quick stop of a hand action is necessary to make use of the foot to kick or to add an attack by footwork.

SUMMARY OF THE INVENTION

This invention is generally summarized as featuring a crosshandled guard baton which comprises a club having a longitudinal axis and a crosshandle transversely branched on the club at a place toward a club end, wherein the crosshandle has a branching length comparable to a breadthal length or width of a man's hand palm and is typically defined by three portional members of a lower grip, central grip and upper grip which are laid or stacked on one another to form a stand on a mounting base on the club, and internally of the crosshandle a longitudinal shaft is secured on the mounting base and is extended to reach through a top end of the upper grip, and the shaft is rotatably supported with the lower and upper grips while the central grip is fastened to the shaft such that the club is turnable around the crosshandle with a concurrent motion of the central grip, keeping the lower and upper grips in independence of the motion with the club and central grip. Further, the crosshandle comprises devices for removing the lower or upper grip from rest of the members defining the crosshandle.

Figure 1:
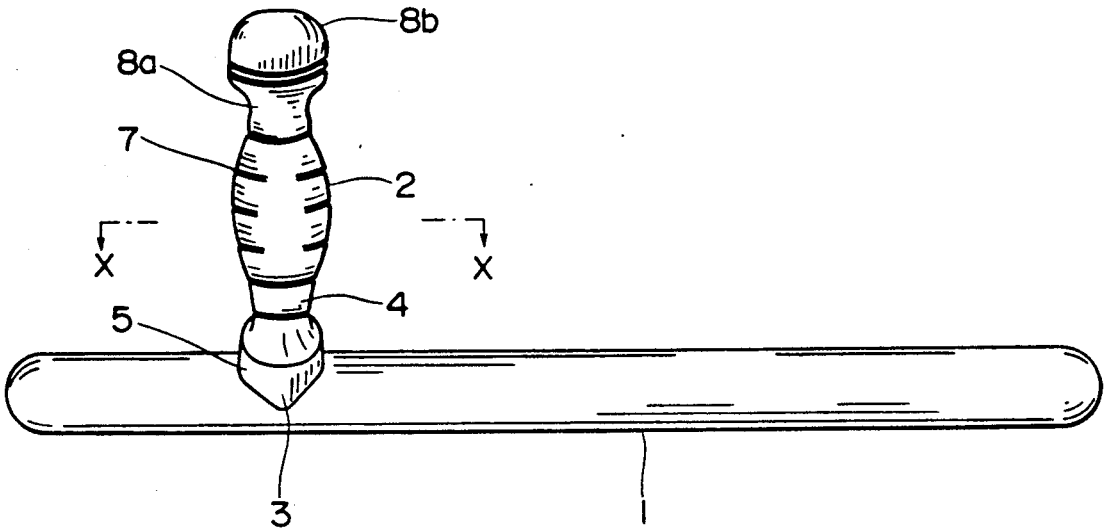
FIG. 1 shows a perspective view of an inventive embodiment.

These drawings are presented to illustrate the invention and therefore these should not be construed as limiting the invention. And in the drawings a like numeral indicates a like part, and a length of the club is sometimes shortened out of scale without a cut mark and such should not be construed to destroy the invention.

DESCRIPTIONS OF THE EMBODIMENTS

It is to be noted here that the term "crosshandle" will often be abbreviated to "handle" in descriptions later.

Figure 2:
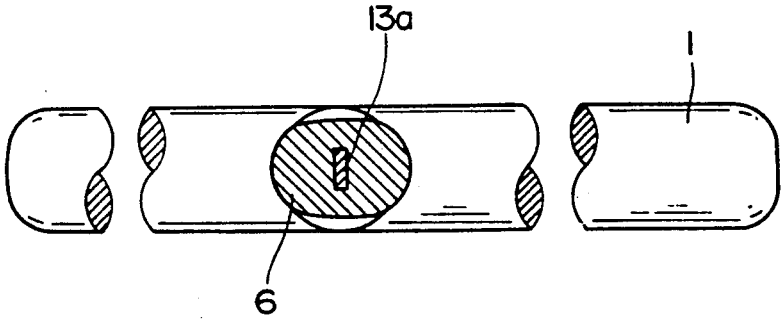
FIG. 2 shows a plan view cut at X—X line noted in FIG. 1.
Figure 3:
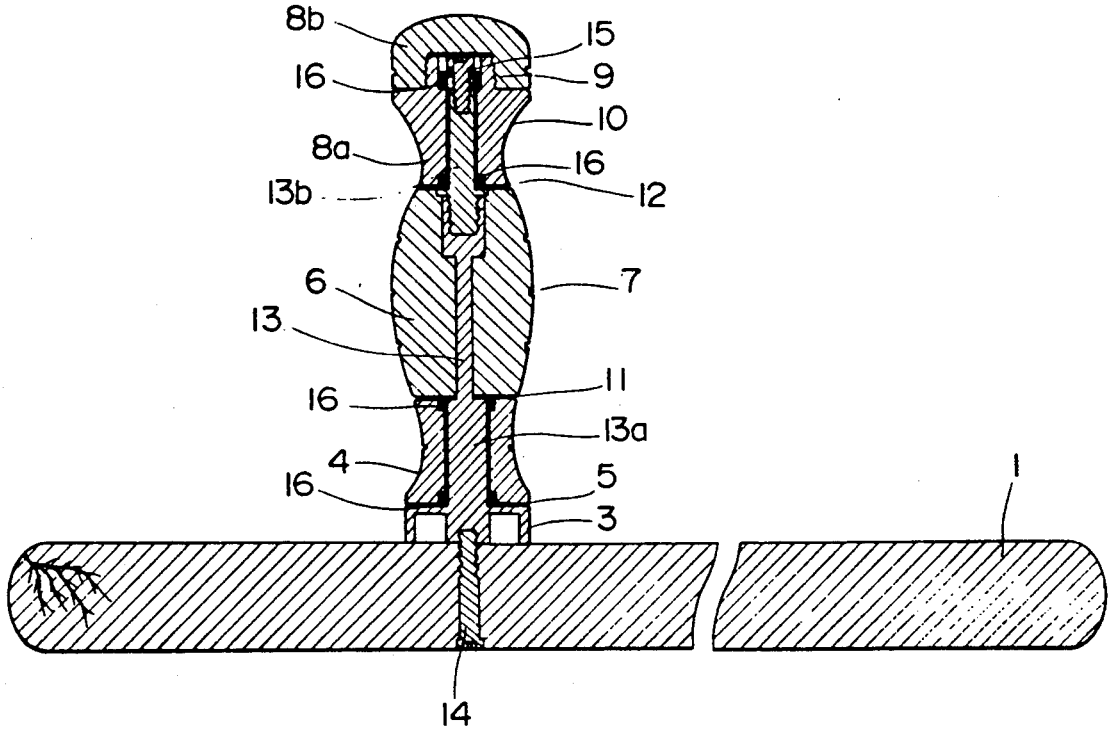
FIG. 3 shows a vertical view in section of another inventive embodiment featuring in comprising upper and lower grip members being rotatable.

With reference to FIGS. 1 to 3, 1 is a club which is made of a hard material, for instance, wood, metal or plastic and, in the case of a plastic, it is recommended to reinforce the plastic with tough aramid fibers, for instance, KEVLAR (brandname), by interlacing such fibers in plastic layers with orientation to an longitudinal axis of the club 1. Size of a club 1 is preferably about 60 cm in length and about 3 cm in diameter. Further, it is preferable for convenience to carrying as well as adjusting a length in use that a full length of a club is divided to a plurality of short members, which will be connected, for instance, by screw fittings instantly and in place.

A handle 2 is transversely branched at a place toward an end of the club 1, wherein a mounting base or saddle base 3 is formed to offer a flat face at the place as mentioned, on which laid or stacked first is a lower grip member 4 which is shaped to be a round brick, wherein a contact plane of the lower grip 4 to the base 3 is formed to make a slide contact plane 5, of which function will appear later. Then, a central grip member 6 is laid or stacked on the grip member 4 to form a similar slide contact plane 11 inbetween and thereafter an upper grip member 8*a* is laid on the central one 6 likewise to form a slide contact plane 12 inbetween. Thereto another upper grip or cap 8*b* is fitted over on top, but between members 8*a* and 8*b* no slide plane is provided. These members after assembly as shown in the drawings will be applied to a handgrip as a handle, size of which is therefore preferably about 11 cm long and diameter of the cap member 8*b* is about 3.5 cm, wherein assembled grip members as a whole are preferably shaped to take a form, like a bowling pin, easy to handgrip as shown in the drawings, in other words, round side faces of the lower grip 4 and upper grip 8*a* are squeezed to recurve and a similar side of the central grip is made like a barrel flank, wherein an outside shape of the handle may be varied from round in section, for instance, to be elliptic in section for further ease to handgrip as shown in FIG. 2.

Making reference to internal structures, a shaft 13*a*, 13*b* (two segments are connected in alignment, but often represented by 13) is provided longitudinally of the handle 2 and is at its footing end secured on a screw 14 which is mounted transversely of the club axis, as FIG. 3 shows, the footing end may be constructed integrally with the base 3 and is extended vertically to reach top end of the grip 8*a* with some interconnection midway as shown in FIG. 3, wherein the shaft 13 is rotatably supported with ball bearings 16, 16, 16, 16, mounted at two vertical ends of two grip members, lower and upper, while the shaft 13 is fastened with the central grip 6, (see FIG. 2. It shows the shaft 13*a* in square section at X—X line in FIG. 1). The structure as noted is annotated here to explain functions in the invention. That is, "rotatably supported" means that, when a rotatably supported grip is firmly held externally, the grip member held externally remains stationary while internally the shaft 13 is let move or turn, and as will be apparent later, in use, two grips of the lower and upper are recommended to be held by the hand palm while the center grip is let free to turn with the club. When the turning club is intended to stop, a touch onto the central grip is used to effect braking action. Therefore, several lateral grooves 7 are provided on the central grip to enhance friction against the hand palm.

The cap 8*b* is mounted on the upper grip 8*a* with a screw fastener 9 and, when disassembling is intended, undoing the fastener 9 leads to easy disassembly.

Figure 4:
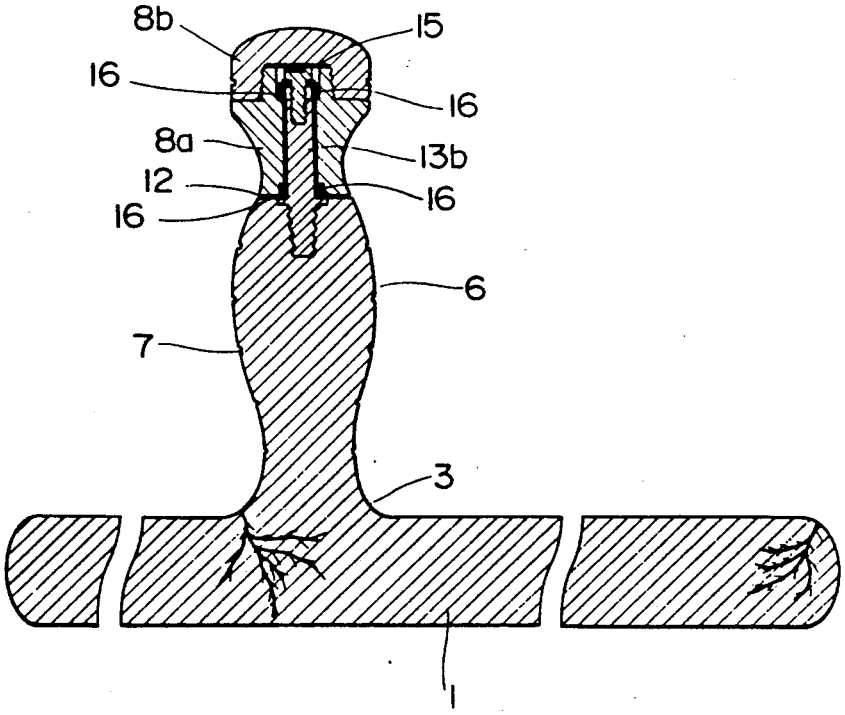
FIG. 4 shows a vertical view in section of a still another inventive embodiment featuring in comprising an upper grip member as only rotatable one.

Note: in the following descriptions to explain new embodiments, explanations will concentrate to new devices and functions which have not yet been described, with abbreviation for repeated description. With reference to FIG. 4, the embodiment is simplified by removing a rotatably supported lower grip member from the structures as shown in FIG. 1. Therefore, a shaft 13 is secured on a level comparable to the top end of the central grip 6 in FIG. 1 and only an upper grip 8*a*, 8*b* is supported rotatably. Therefore, firm gripping on the upper grip is recommended to rotate and additional gripping over the other handle portion is needed to brake rotation of the club.

Figure 5:
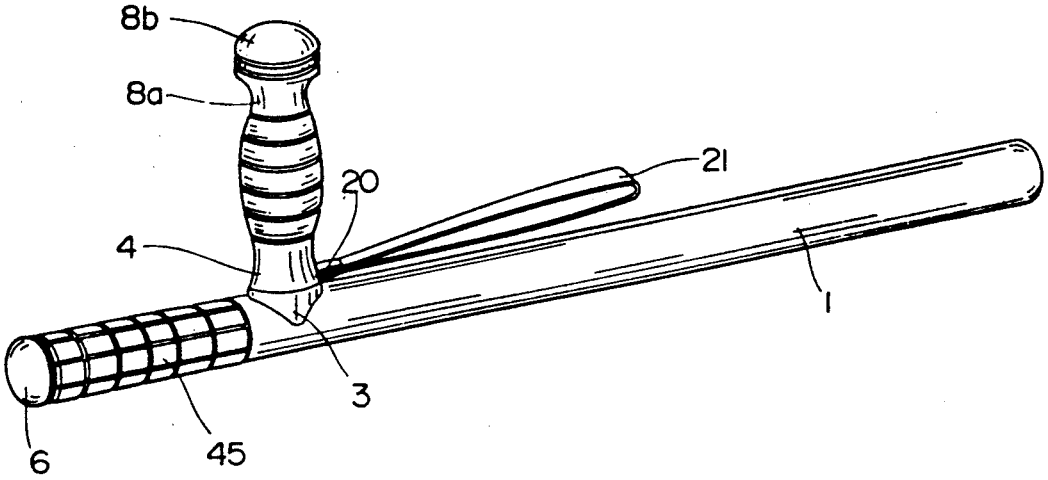
FIG. 5 shows a perspective view of further another inventive embodiment featuring in comprising a strap band.
Figure 6:
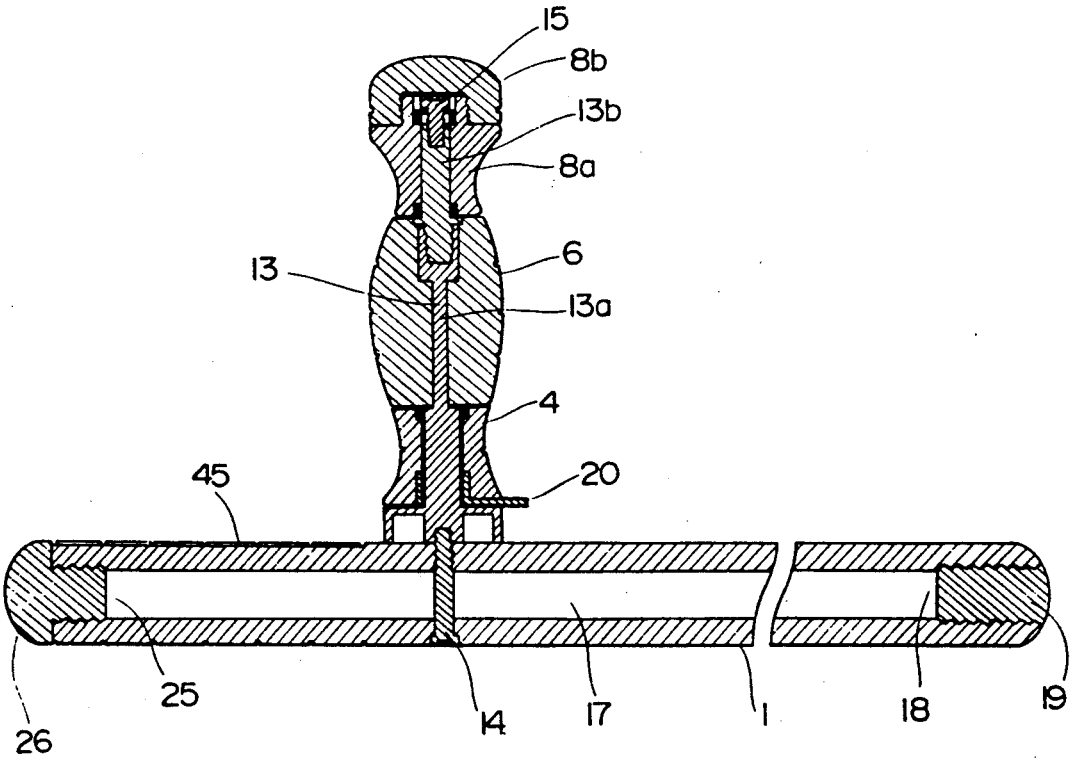
FIG. 6 shows a vertical view in section of the embodiment as shown in FIG. 5.
Figure 7:
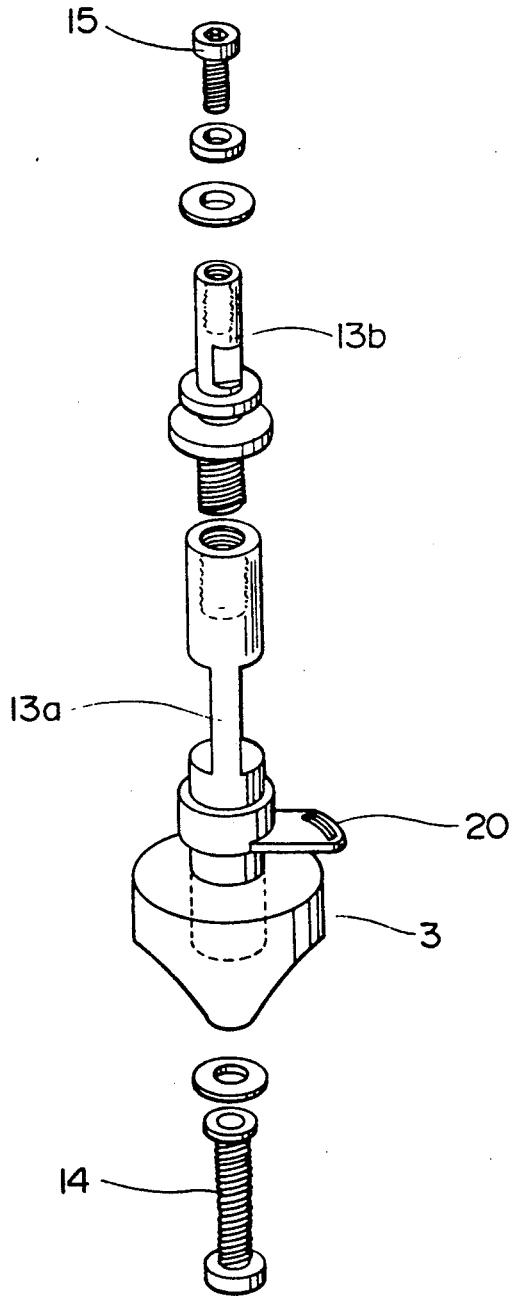
FIG. 7 shows a burst view of a shaft comprised in the embodiment as shown in FIG. 5.

With reference to FIGS. 5–7, first, externally a ring strap band 21 is fitted to make sure of a gripping by hand and is tied with a mounting end 20. Size of the band is preferable in about 20–25 cm in fold form. A mounting position may be changed anywhere around the handle. And crossed grooves for anti-slip purpose are provided on a handgrip portion 45 of the club 1. Internally, the club is made hollow to provide an interior space and openings 18, 25 of two ends of the club 1 are closed by plugs 19, 26. FIG. 7 shows a shaft assembly in burst form wherein 14 is a king pin screw 14 which will be set transversely across the club 1 to fit in a footing end of the shaft 13*a*, and the top end of the shaft 13*a* is designed to screw-connect to another segment of the shaft 13*b* which is equipped with ball bearings (not shown) and 15 is a screw to fasten or to clamp the assembly as a whole on top. 20 is a mounting end for a strap.

Figure 8:
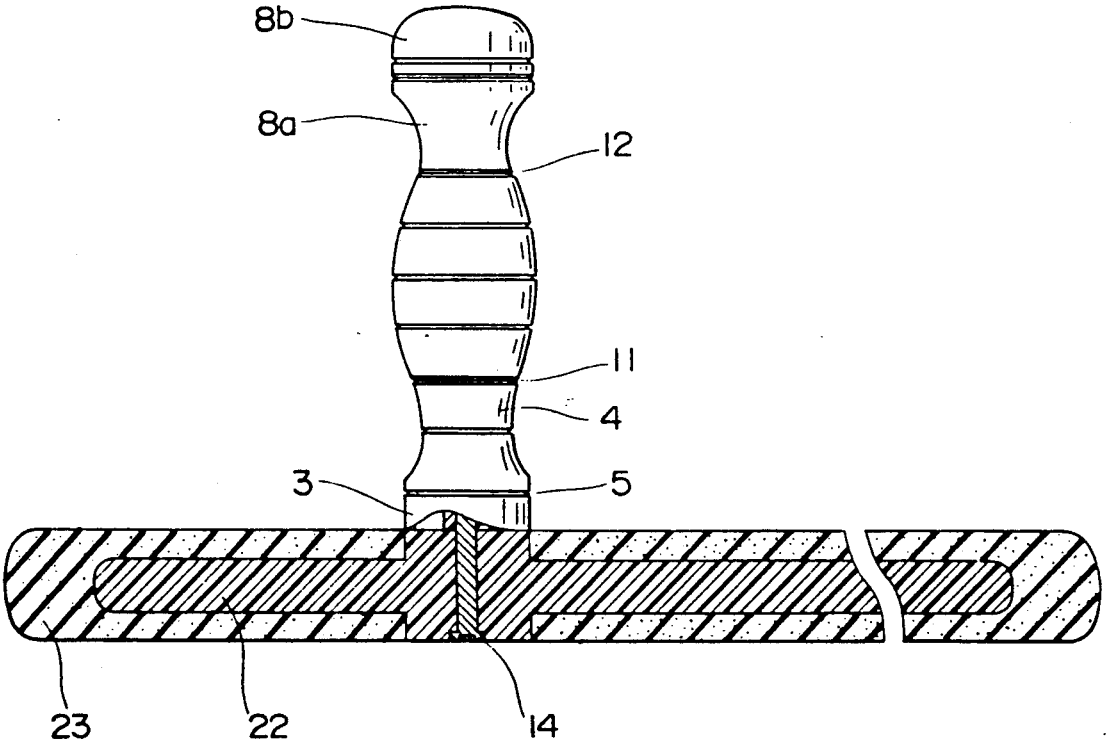
FIG. 8 shows a vertical view, partly in section, of an embodiment featuring in an anti-slip cover being applied on a club.

With reference to FIG. 8, internal core portion 22 of the club 1 is made of a hard material, for instance, a hard plastic and cladded or covered with an elastic, for instance, spongy material 23 to avoid a undesirable slip.

Figure 9:
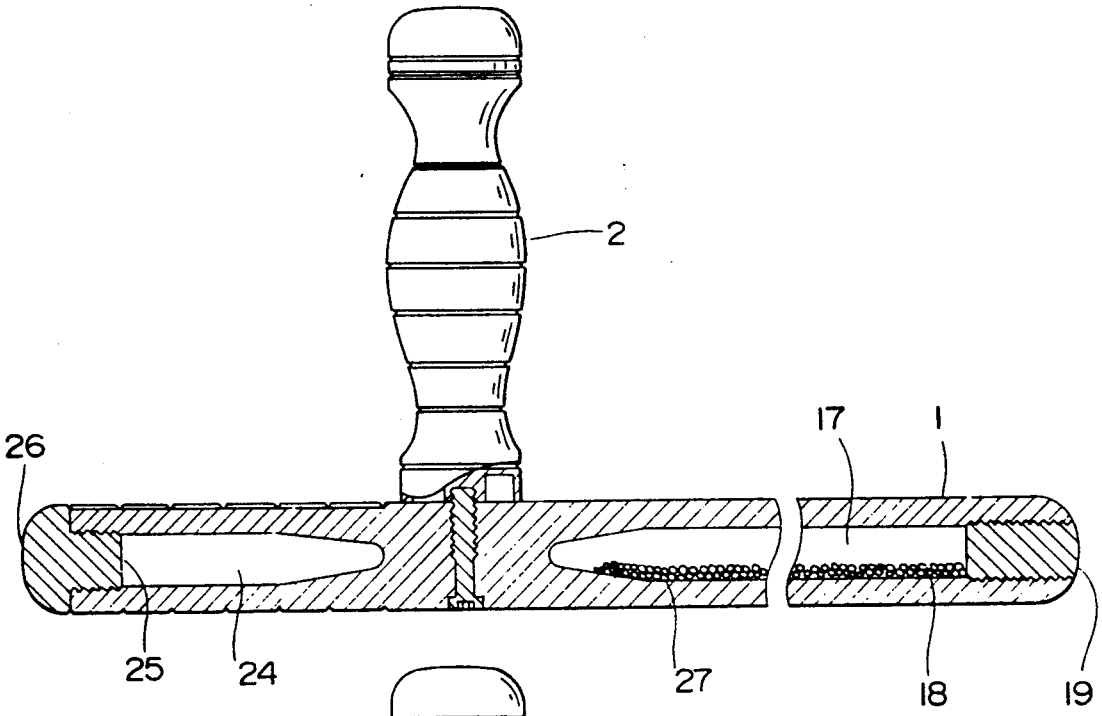
FIGS. 9 to 12 show vertical views, partly in section, of embodiments featuring in internal devices of each club.
Figure 10:
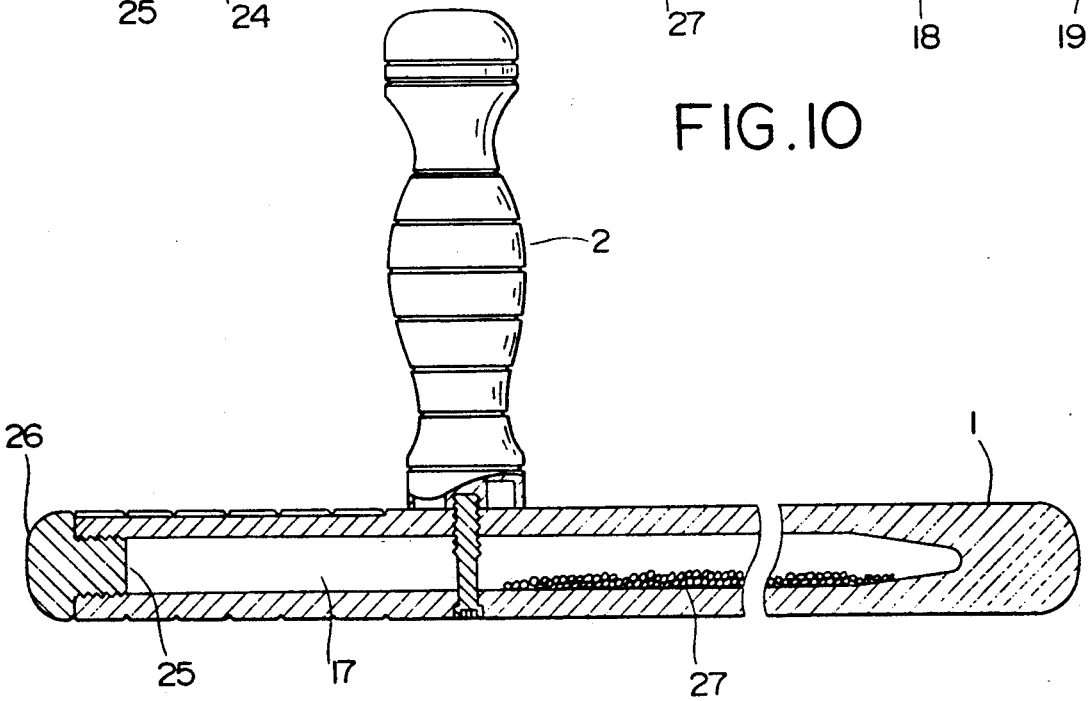
Figure 11:
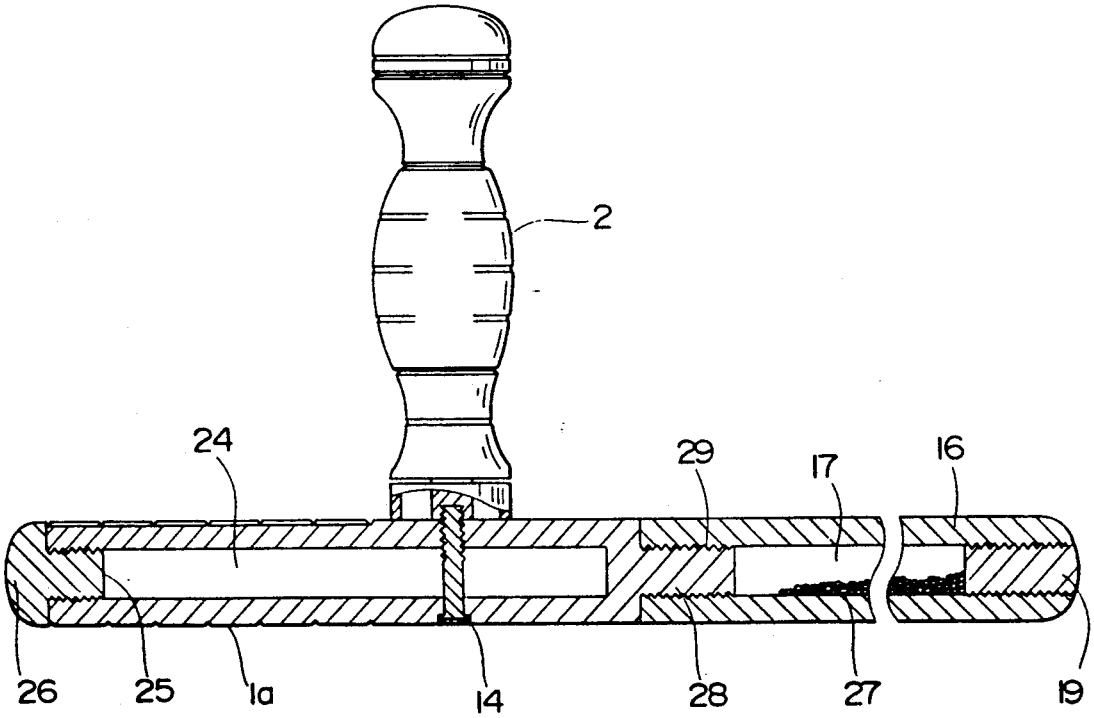

With reference to FIGS. 9 to 11, the club 1 is internally made to be a longitudinal hollow space, which is divided to two spaces 17, 24 in the case of FIG. 9 and two end openings 18, 25 are closed by plugs 19, 26, wherein a weight 27 composed of metal particles or beads is provided to accelerate centrifugal force. In the case of an embodiment of FIG. 11, the club is so designed as to be connected of two segments 1*a*, 1*b*, and the segment 1*b* contains a weight 27 and is connected by screw-fitting 28, 29 so that an independent compartment 24 is formed in the segment 1*a* which may be used to store small properties of a user.

Figure 12:
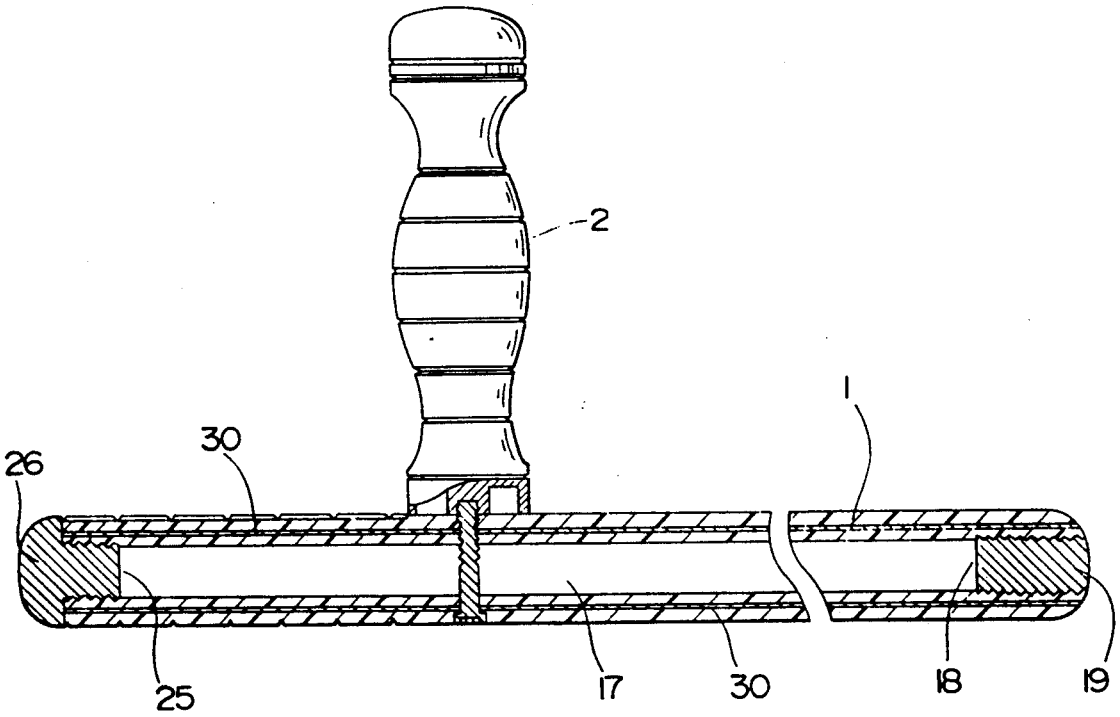
Figure 13:
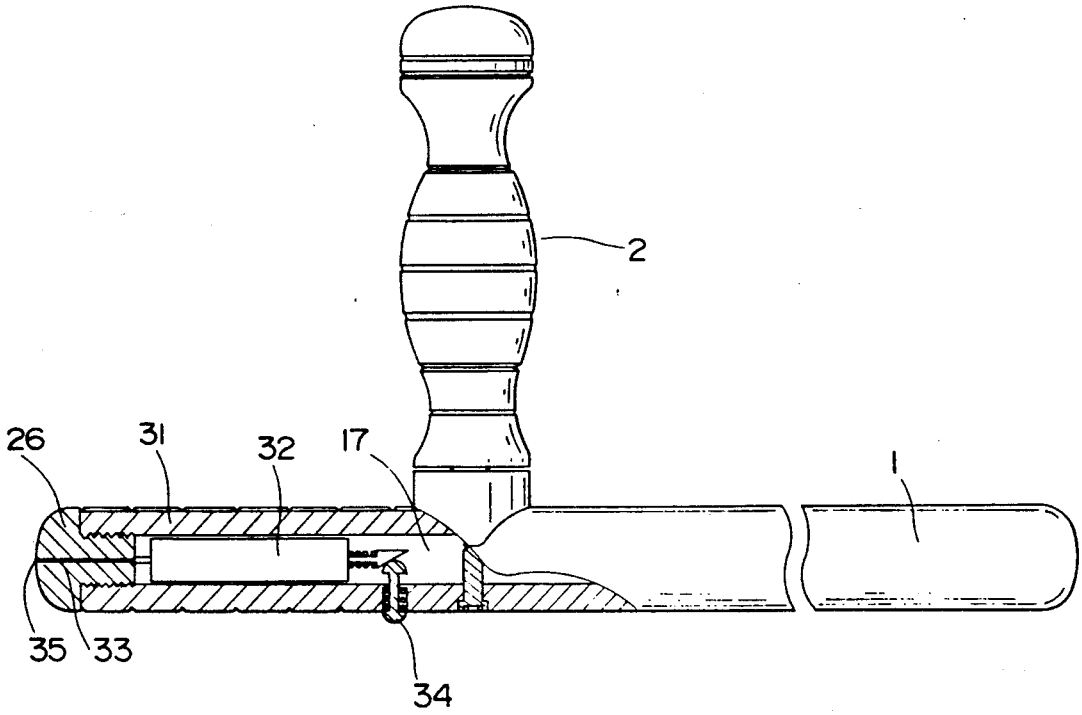
FIG. 13 shows a vertical view, partly in section, of an embodiment featuring in provision of a gas ejecting device in a club.

With reference to FIG. 12, this embodiment features in fiber reinforcement 30 with use of a tough kind of fiber as noted before. With reference to FIG. 13, this embodiment features in provision of a gas ejecting device contained in the club body 1, wherein 32 is a gas bomb and 34 is a nob switch or trigger to burst the bomb, and 33 is a gas ejecting nozzle, then 35 is a nozzle hole, through which an exploded gas, for instance, tear gas or smoky gas will be ejected outside.

Figure 14:
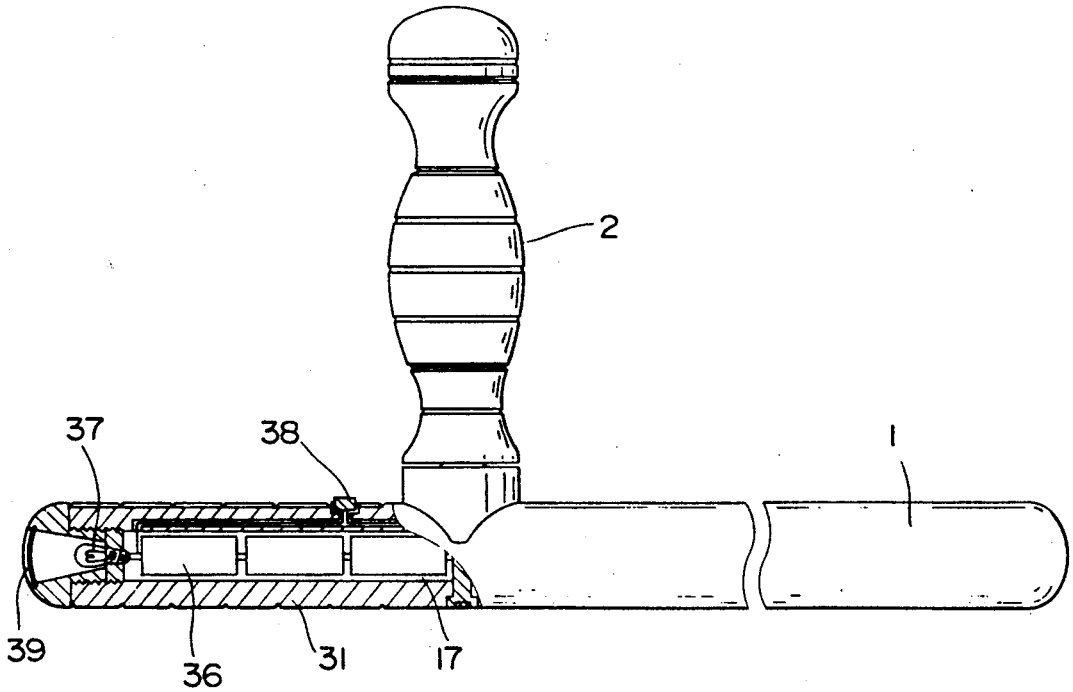
FIG. 14 shows a vertical view, partly in section, of an embodiment featuring in provision of a lightening or illuminating device in a club.

With reference to FIG. 14, this embodiment features in provision of a lightening or illuminating device in the club interior, in place of the gas ejector in the foregoing. Referring to the lightening device, therein 36 is a battery, 37 is a lamp, 38 is a switch and 39 is a lens window as is easily understood.

Figure 15:
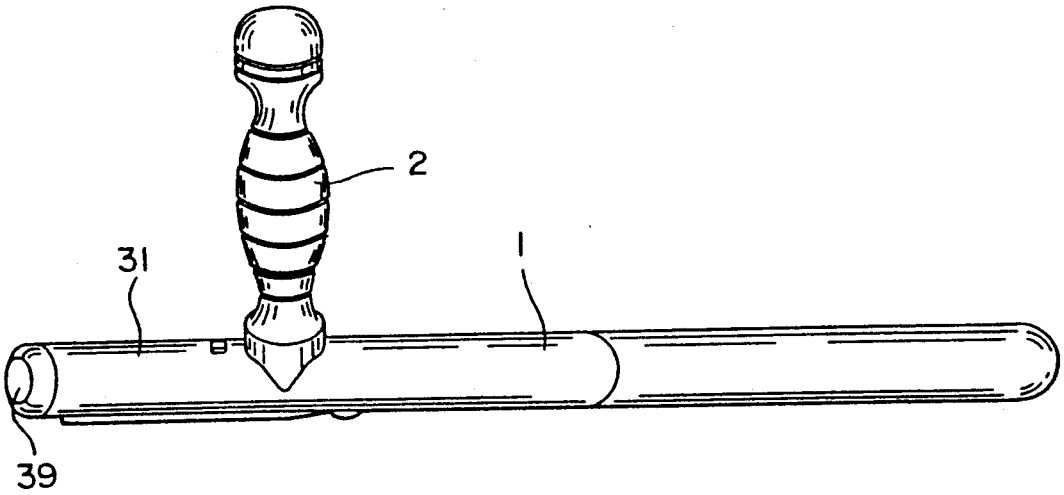
FIG. 15 shows a perspective view of an embodiment featuring in provision of a lightening or illuminating device and a gas ejecting device in a club.
Figure 16:
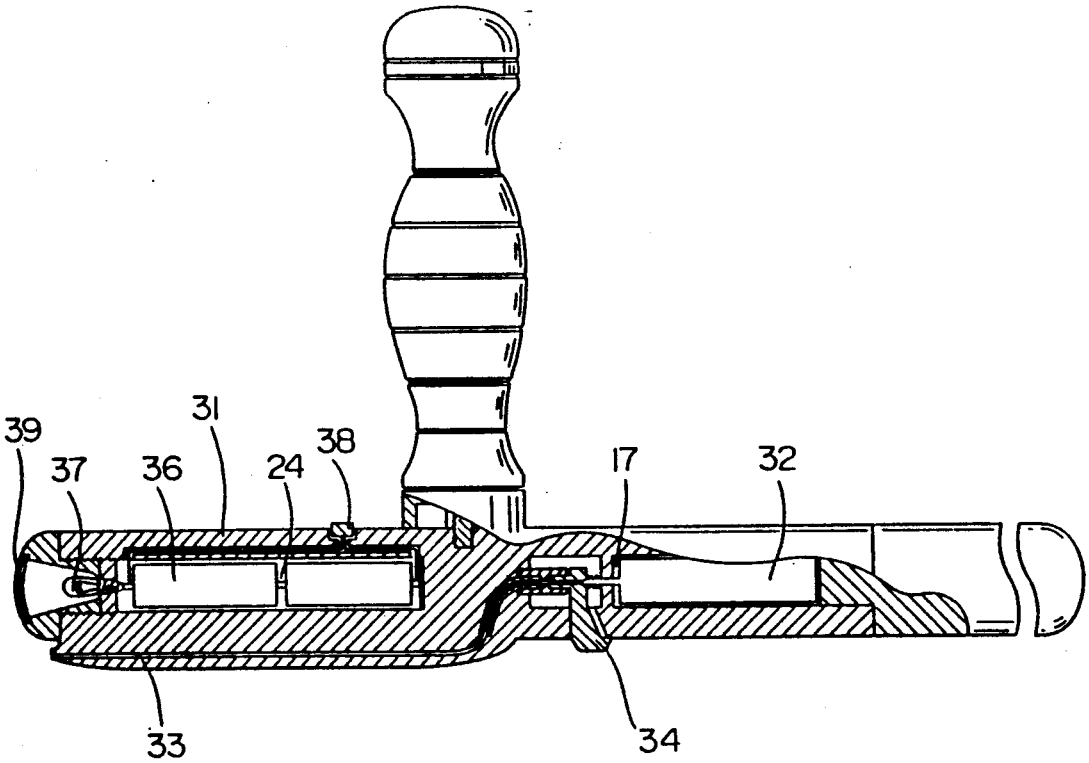
FIG. 16 shows a vertical view, partly in section, of the embodiment as shown in FIG. 15.

With reference to FIGS. 15 and 16, features are that internal devices of the club 1; a lightening or illuminating device and a gas ejecting device are accommodated in two divided spaces of the club 1, wherein a direction of casting light and that of ejecting a gas are conformed as is shown to the left in the drawing, and the device for ejecting a gas is set in the right-half space 17 and a nozzle 33 is directed to the left therein. In use, if the lightening device is unnecessary, the lamp 37 is recommended to be removed and a cap 26 as shown in FIG. 15 is applied in place.

Figure 17:
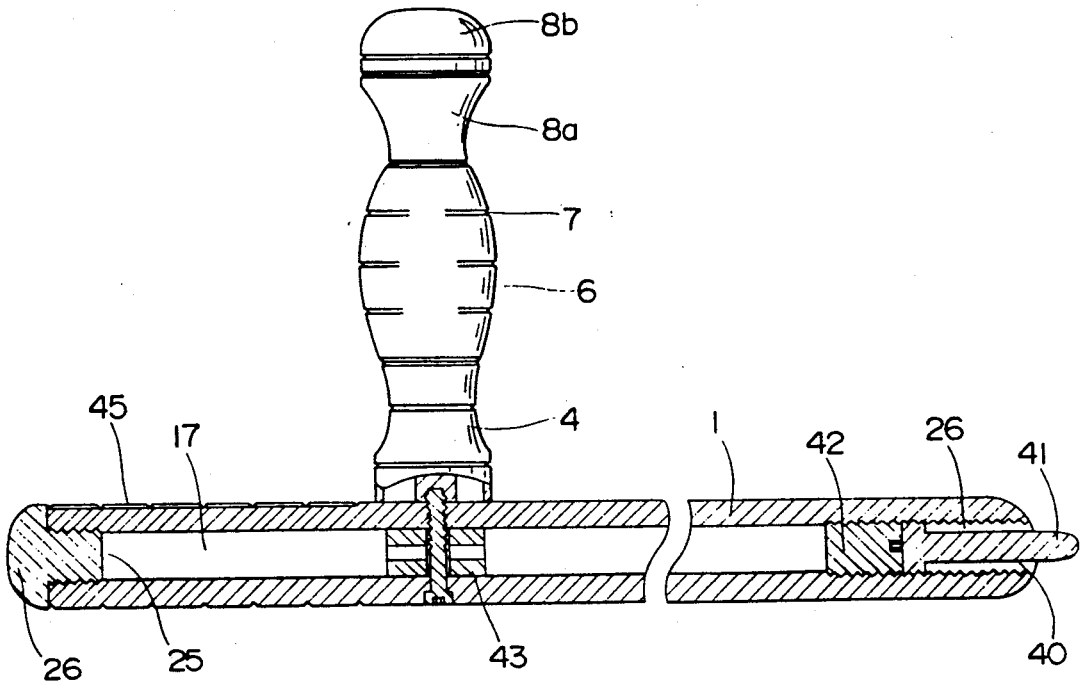
FIGS. 17 and 18 show vertical views, partly in section, of embodiments featuring in provision of a jabbing device.
Figure 18:
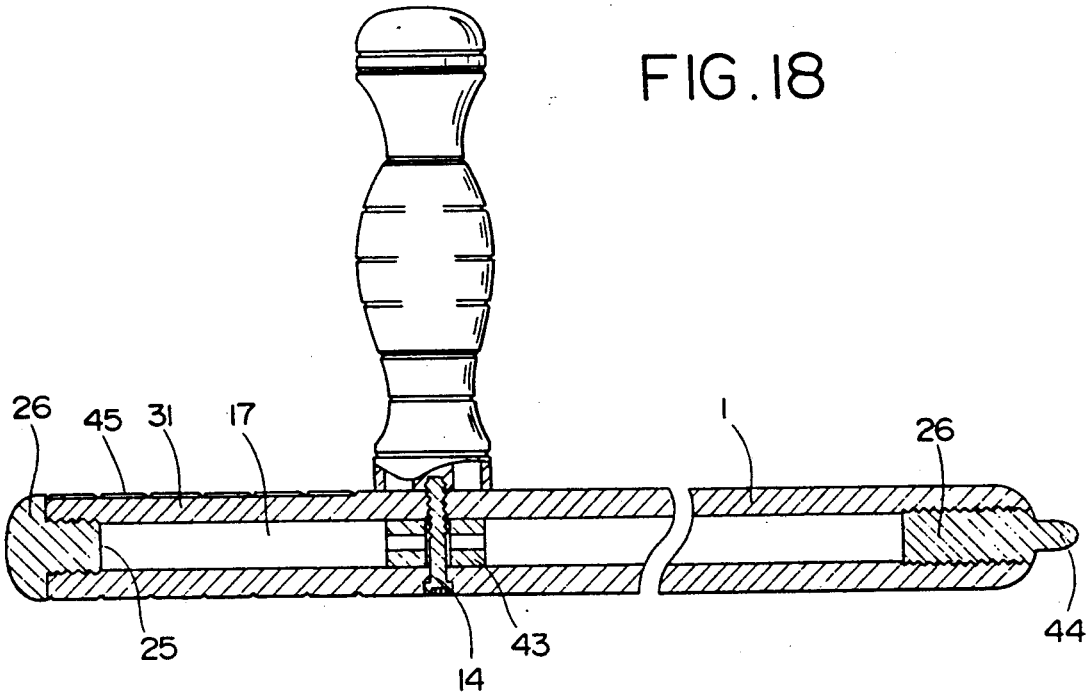

With reference to FIGS. 17 and 18 featuring in internal devices of the club 1, in a space adjacent to an end opposite to a grip portion 31 or 45, a pointing device is mounted so as to facilitate a jab action, wherein a plug 26 is provided with a through hole 40, and therethrough a pointer member 41 is fitted and an assembly of the pointer 41 and the plug 26 is set so as to connect to a pack 42 mounted inwardly wherein a tip of the pointer 41 is adjusted to be slightly out of the rod end, and 43 is a shock absorber. In the case of FIG. 18, a plug 26 is designed to serve as a pointer 44, which is exchangeable to a normal plug as shown in the left hand end.

Figure 19:
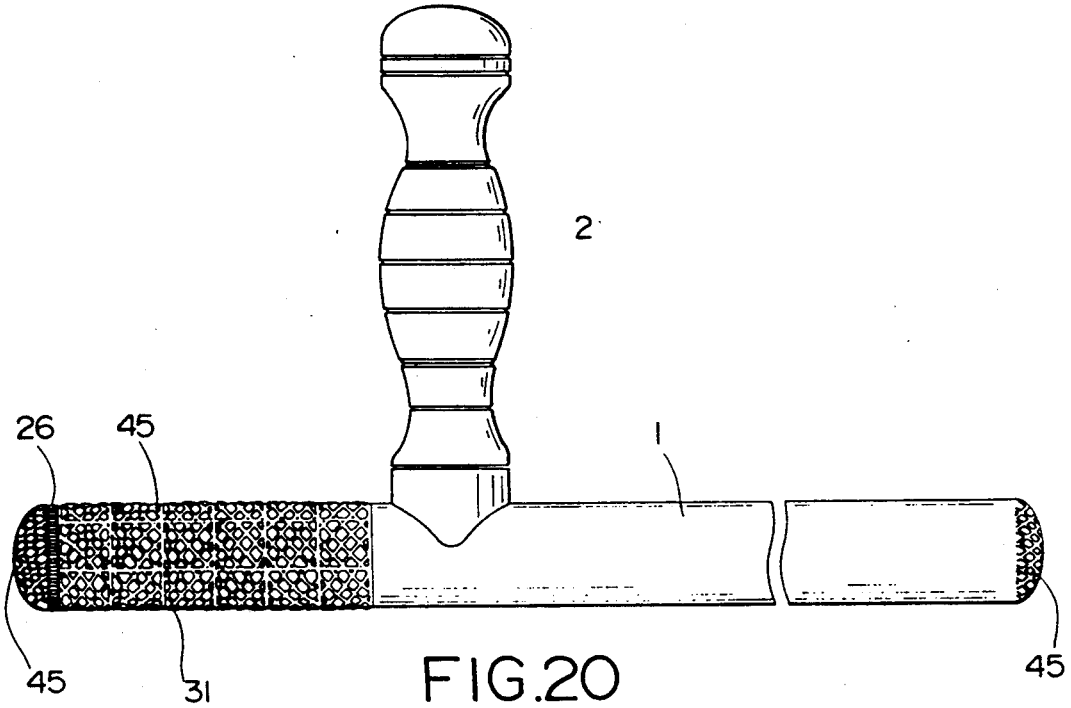
FIG. 19 shows a perspective view of an embodiment featuring in application of a removable anti-slip device.

With reference to FIG. 19, on the club 1, cross-hatched net irregularities are provided to avoid a slip with a grip portion 31 and two ends, which are commonly numbered 45.

Figure 20:
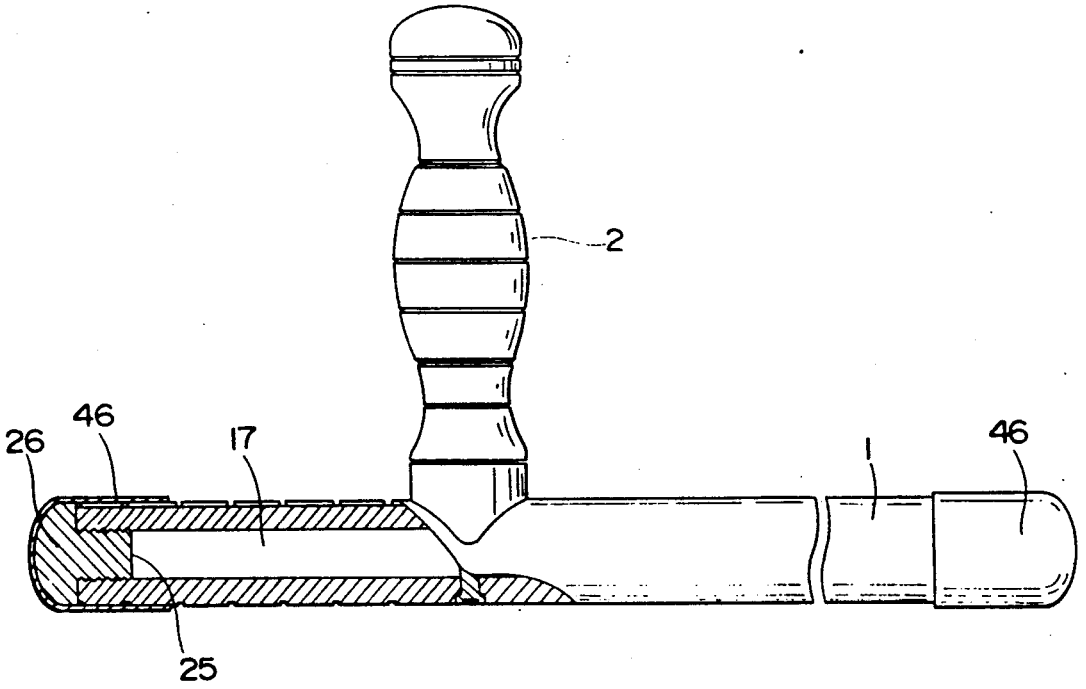
FIG. 20 shows a vertical view, partly in section, of an embodiment featuring in application of an anti-slip cap.

With reference to FIG. 20, at one or two ends of the club 1, a cap 46, made of a spongy material, for instance, is applied to avoid a slip.

CONCLUSIVE STATEMENT

The invention being thus described, it will be obvious that the same may be varied in many ways. Such variations are not to be regarded as a departure from the spirit and scope of the invention, and all such modifications as would be obivous to one skilled in the art are intended to be included within the scope of the following claims.

What is claimed is:

1. A crosshandled guard baton which comprises:

a club having a longitudinal axis and a crosshandle perpendicular to the longitudinal axis of the club and supported internally by a shaft secured to a mounting base located toward one end of said club, said crosshandle having a length substantially equal to the width of a man's palm and comprising a lower grip, a central grip and an upper grip stacked on one another with said lower grip adjacent said mounting base, said shaft being secured internally of said central grip and rotatably supported internally of said lower grip and said upper grip, whereby said central grip and said shaft are rotatable together relative to said upper grip and said lower grip thereby permitting turning movement of said club relative to said lower grip and said upper grip.

2. A crosshandled guard baton as claimed in claim 1, wherein the shaft is rotatably supported with a ball bearing.

3. A crosshandled guard baton as claimed in claim 1, wherein the crosshandle grip secured to the club is shaped to be elliptic in cross-section and a major axis of the elliptic cross-section is substantially parallel to the longitudinal axis of the club.

4. A crosshandled guard baton as claimed in claim 1, wherein the club is comprised of a hard plastic core cladded with a spongy, anti-slip elastic material.

5. A crosshandled guard baton as claimed in claim 1, wherein the club is provided longitudinally with at least one hollow interior space, each end of the club is open to a hollow interior space and said ends of the club are closed by plugs.

6. A crosshandled guard baton as claimed in claim 5, wherein a weight is received in the hollow space.

7. A crosshandled guard baton as claimed in claim 5, said guard baton further comprising in the hollow space a gas ejecting device to be directed to outside the club, wherein the gas ejecting device is operable by a manual manipulation.

8. A crosshandled guard baton as claimed in claim 5, wherein said guard baton further includes an illuminating device in the hollow space, said device is operative to direct light outside the club, and manual means for operating said illumination device.

9. A crosshandled guard baton as claimed in claim 5, wherein the club is separated at said crosshandle into two interior hollow spaces, an illuminating device is provided in one of said hollow spaces, a gas ejecting device is provided in the other hollow space, and manual means for independently operating the illuminating device and the gas ejecting device are provided adjacent the crosshandle.

10. A crosshandled guard baton as claimed in claim 1 wherein the club is provided with a removable anti-slip device at at least one end of said club.

11. A crosshandled guard baton as claimed in claim 1 wherein the club is provided with a removable anti-slip cap at at least one end of said club.

12. A crosshandled guard baton as claimed in claim 1, wherein said upper grip is formed with a surface contour comprising a first portion of gradually reducing diameter extending outwardly from said central grip and a second portion of gradually increasing diameter blending with said first portion to provide a finger gripping recess in said upper grip at the outer end of said central grip.

* * * * *